US005581819A

United States Patent [19]

Garneau

[11] Patent Number: 5,581,819

[45] Date of Patent: Dec. 10, 1996

[54] PROTECTIVE HEADGEAR AND ABUTMENT PLATE THEREOF

[76] Inventor: Louis Garneau, 246, Chemin de la Butte, St-Augustin-de-Desmaures, Québec, Canada, G3A 1W7

[21] Appl. No.: 544,672

[22] Filed: Oct. 18, 1995

[51] Int. Cl.[6] ..... A42B 3/08

[52] U.S. Cl. ..... 2/421; 2/425

[58] Field of Search ..... 2/410, 411, 417, 2/418, 421, 422, 425, 420, 415

[56] References Cited

U.S. PATENT DOCUMENTS

| | | | |
|---|---|---|---|
| 2,814,043 | 11/1957 | Alesi | 2/421 |
| 3,852,821 | 12/1974 | Mickel | 2/421 |
| 4,075,715 | 2/1978 | Cowgill | 2/421 |
| 4,703,879 | 11/1987 | Kastendieck et al. | 2/422 |
| 4,884,301 | 12/1989 | Aileo | 2/421 |
| 5,121,508 | 6/1992 | Grilliot et al. | 2/421 |
| 5,179,735 | 1/1993 | Thomanek | 2/421 |
| 5,315,718 | 5/1994 | Barson et al. | 2/421 |
| 5,381,560 | 1/1995 | Halstead | 2/421 |

FOREIGN PATENT DOCUMENTS

| | | | |
|---|---|---|---|
| 95/01739 | 1/1995 | WIPO | 2/421 |

*Primary Examiner*—Michael A. Neas
*Attorney, Agent, or Firm*—Francois Martineau

[57] ABSTRACT

This invention relates to a protective helmet for a cyclist having a conventional shock-absorbing shell and a fastening strap. The rear part of the fastening strap is threaded through an abutment plate which is slightly concave and destined to bear on the occipital bone of the head of the cyclist. The front part of the fastening strap is attached to the front part of the helmet. The abutment plate is attached to a loop band which hangs from the rear part of the helmet. When the cyclist puts the helmet on and fastens the fastening band, the abutment plate bears on his occipital bone to prevent the helmet from tilting frontwardly in the sagittal plane.

7 Claims, 3 Drawing Sheets

Fig. 3
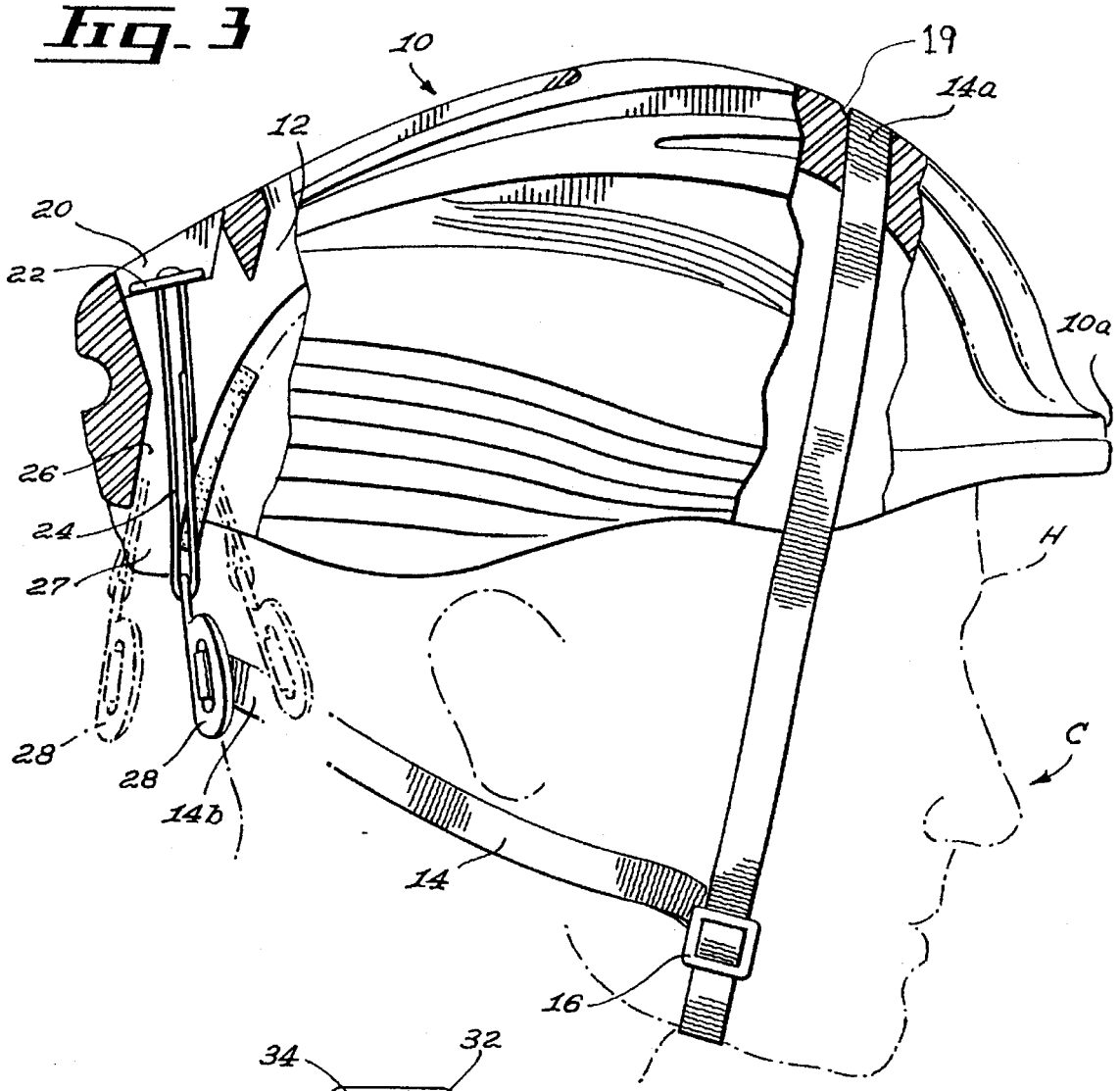
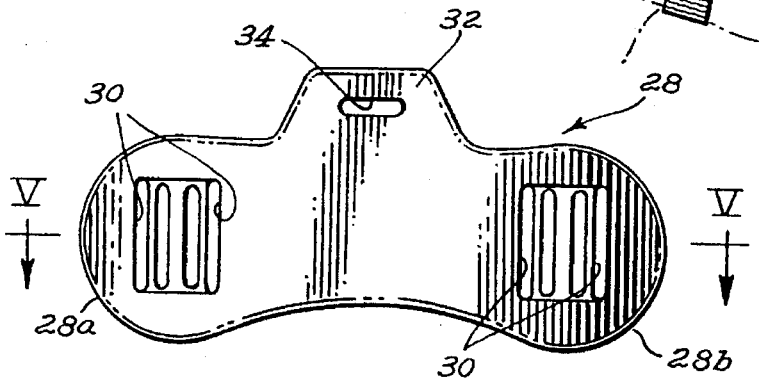
Fig. 4
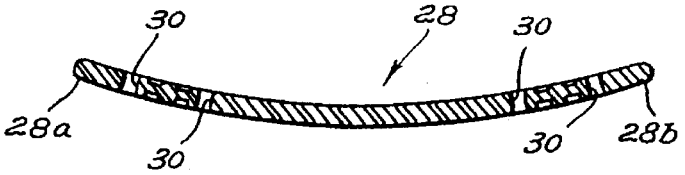
Fig. 5

PROTECTIVE HEADGEAR AND ABUTMENT PLATE THEREOF

FIELD OF THE INVENTION

The present invention relates to a retaining device for a protective headgear, for preventing the headgear from tilting on the wearer's head.

BACKGROUND OF THE INVENTION

Protective headgears are used for both outdoor and indoor activities, e.g. cycling. When riding, the cyclist is prone to fall from—or be thrown off—his bicycle and his head may hit a hard surface with relatively high velocity. The injuries resulting from such an impact may lead to dire consequences such as permanent damage to the skull, the spine, or even the death of the cyclist. This is the reason why protective helmets have a growing popularity among cyclists.

One type of protective headgear for a cyclist is described in the U.S. Pat. No. 5,351,342, issued in 1994 to the applicant Louis Garneau. This helmet comprises an inner soft shock-absorbing insert and an outer more rigid shell embedded on the periphery of the former. A plurality of ventilation openings are fitted in registration through both layers. The helmet is provided with a retention strap, of known construction at the time the patent was issued, that is inserted into predetermined transverse openings of the helmet. Two rear openings communicate with one another by means of a transverse groove positioned at the rear part of the helmet between the external shell and the insert. Similarly, two front openings communicate by means of another transverse groove positioned at the front part of the helmet between the insert and the external shell. As shown in FIGS. 3*a* and 4*a* of the patent, the strap overlies the above-mentioned grooves and passes through both the above-mentioned rear and front openings to extend well under the insert. In use, the front straps are destined to lie alongside the temples and the cheeks, while the rear straps are destined to lie alongside the skull behind the ears, each front strap joining one rear strap just under the ear. Each pair of front and rear straps can then be removably secured with strap fasteners of known construction.

Such a helmet covers the upper hemisphere of the head and is to be strapped under the chin of the wearer for fastening it to the head. These helmets often protect adequately the head of the cyclist, but are prone to tilt forward during the chaos of the fall and the resulting impacts. Indeed, the straps are laterally positioned, relative to the cyclist's head, and therefore reduce or prevent the lateral tilting of the helmet. Also, the downwardly extending rear end of the helmet combined with the front part of the fastening strap prevent most of the backward tilting. However, frontward tilting of the helmet in the sagittal plane is a more probable and therefore dangerous occurrence, since the front end of the helmet does not extend downwardly very far to prevent the obstruction of the visual field of the wearer. The helmet may consequently tilt significantly when impacting with a hard surface. This is of course highly undesirable, since a second impact after the helmet has thus moved could occur on important and uncovered parts of the head.

To obviate this important disadvantage, some helmets were designed with a rigid abutment plate downwardly depending from the rear end of the helmet through the instrumentality of an integral rigid elongated link pivotally attached to the helmet. The link and abutment plate, by means of the pivotable attachment of the former, can pivot back and forth at the rear of the helmet, the abutment plate being positioned just under the helmet insert and two rearwardly oriented extremities of the fastening strap being attached to it. Thus, when the fastening strap is fastened under the chin of the cyclist, the rearwardly oriented extremities pull on the abutment plate to pivot the latter towards the head of the cyclist until it abuts on said head, on the occipital bone. The helmet is thus less likely to tilt frontwardly, for the abutment plate will retain it in that direction.

OBJECTS OF THE INVENTION

It is an object of this invention to provide an improved abutment plate for a protective headgear that will hamper or prevent the forward tilting of the headgear in the sagittal plane.

SUMMARY OF THE INVENTION

The present invention relates to a retaining device for a protective headgear, for preventing the headgear from tilting on the wearer's head.

More particularly, the protective headgear of the invention is for use on a person's head, said head having an occipital bone over the nape and a sagittal plane being vertical and dividing said head into right and left halves, said headgear comprising a shock-absorbing shell defining a front and a rear end, said headgear further comprising a fastening strap attached to said headgear and destined to be adjustably and releasably attached under the chin of said head, flexible and rotatable link means pivotally attached to said headgear rear end and an abutment plate pivotally and downwardly depending from said link means and attached to said fastening strap, said abutment plate being destined to bear upon said occipital bone when said headgear is worn by said cyclist and therefore hamper or prevent any tilting of said headgear frontwardly in said sagittal plane.

Preferably, said abutment plate is in adjustable relation with said fastening strap, whereby said abutment plate will bear on said occipital bone when said fastening strap is attached under said chin and will disengage said occipital bone when said fastening strap is released.

Advantageously, said link means is a loop band attached to said headgear rear end, whereby said abutment plate downwardly extends spacedly under the lower periphery of said headgear and is free to pivot at the extremity of said loop band.

Preferably, said headgear defines a longitudinal vertical plane dividing it into two symmetrical halves, said shell further comprising an integral downwardly projecting tongue positioned at said rear end of said headgear, said tongue having a groove correctly dimensioned to receive said loop band so as to position the latter in said longitudinal vertical plane when said headgear is in a vertical position.

Advantageously, said abutment plate is elongated and its longitudinal axis defines a slight curve, said abutment plate, when bearing on said occipital bone, being destined to be so positioned that said curve register in a concave adjacent fashion with said occipital bone.

Preferably, said abutment plate has at least two widthwise slots and said fastening strap engages said abutment plate in said at least two slots.

DESCRIPTION OF THE DRAWINGS

In the annexed drawings:

FIG. 3 is a side elevation of a cyclist's head wearing a protective headgear of FIGS. 1 and 2;

FIG. 4 is an elevation, at an enlarged scale, of the preferred embodiment of the abutment plate; and FIG. 5 is a cross-sectional view taken along line V—V of FIG. 4.

DETAILED DESCRIPTION OF THE PREFERRED EMBODIMENT

Figure 1:
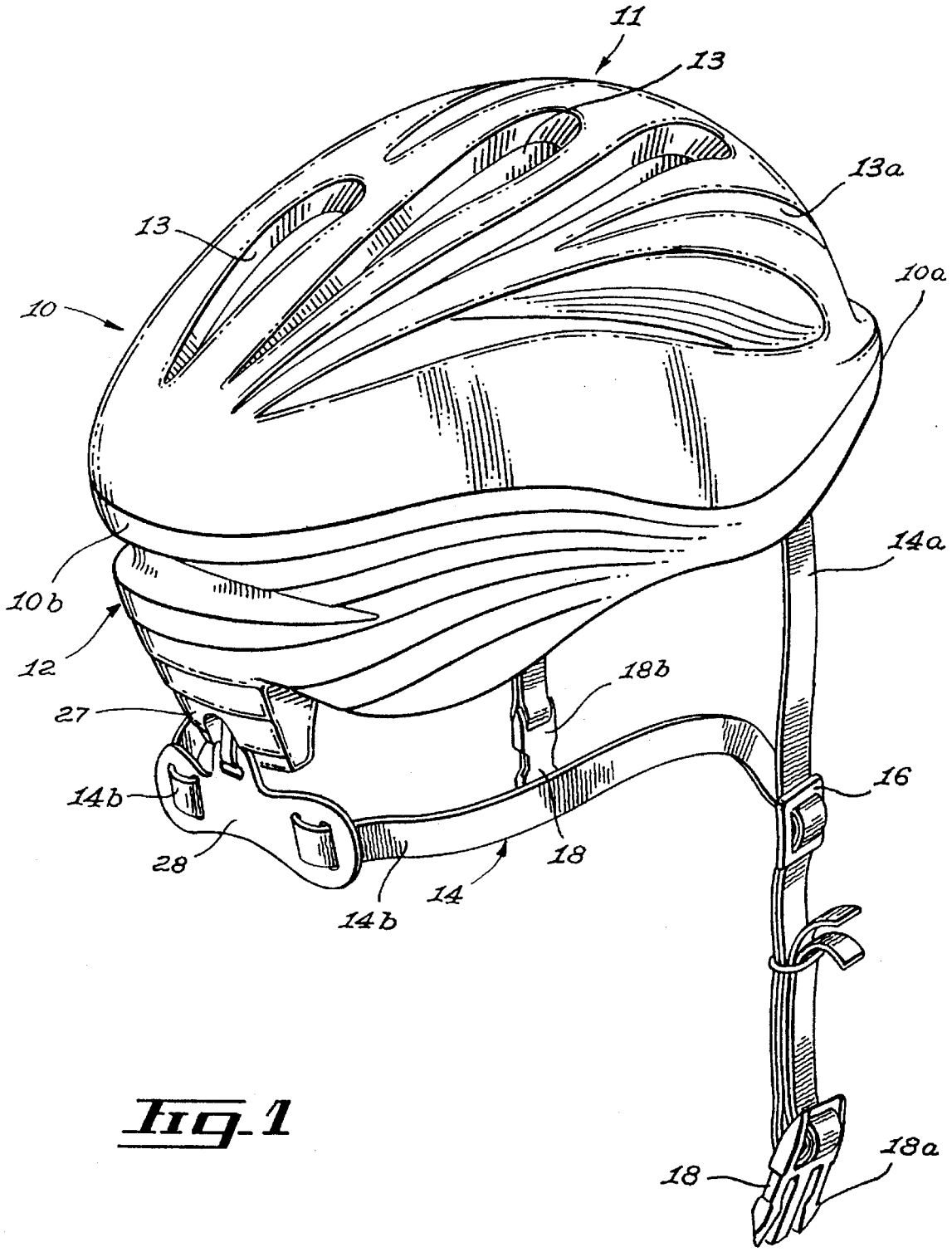
FIG. 1 is a perspective view of the preferred embodiment of the headgear.
Figure 2:
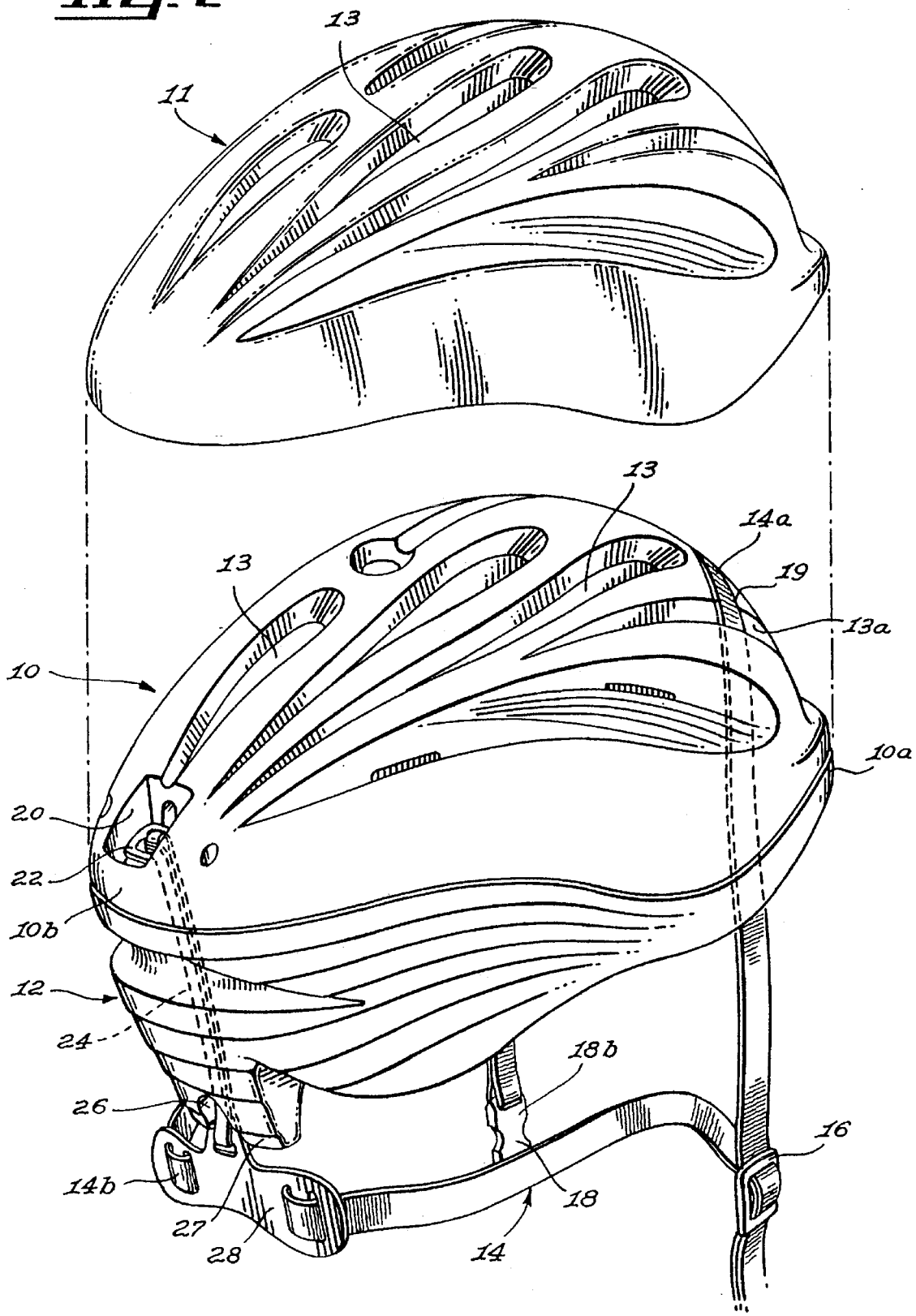
FIG. 2 is an exploded perspective view of the headgear of FIG. 1.

A protective headgear or helmet 10 for a cyclist is shown in FIGS. 1 and 2. Helmet 10 defines a front and a rear end 10*a*, 10*b* and a longitudinal vertical plane of symmetry dividing helmet 10 into two substantially symmetrical halves and comprises a thin cosmetic shell 11 overlying a shock-absorbing shell 12 made, for example, of expanded polystyrene. Shell 12 has a sufficient thickness to absorb the shock of an impact between the helmet and a hard surface, as is known in the art, and downwardly extends well beyond the lower periphery of cosmetic shell 11. Helmet 10 comprises a plurality of elongated ventilation openings 13, 13*a* scattered over the upper surface of shell 12. This design of protective helmet 10 is known in the art.

Helmet 10 is also provided with a fastening means that comprises a first and a second front strap segment which can be remvably attached to one another by an attachment member at their respective lower extremity, a rear strap segment at the lower extremity from which depends an abutment plate and a first and a second floating strap segments which link the abutment plate to respectively the first and the second front strap segments. In the preferred embodiment of the present invention, the first and second front strap segments and the first and second floating strap segments are made from a single strap.

Indeed, as shown in the drawings, it can be seen that helmet 10 more particularly comprises fastening strap 14 of known construction. Strap 14 comprises a length adjuster 16 and a male and a female part 18*a*, 18*b* of a releasable attachment member 18.

Fastening strap 14 passes through a first 13*a* and a second (not shown) opening, overlying shock-absorbing shell 12 between these two openings which communicate by means of a transverse groove 19 near front end 10*a* of helmet 10. Therefore, helmet 10 can be retained by its front end 10*a* through the instrumentality of the front part 14*a* of fastening strap 14. The first and second openings 13, 13*a* together with transverse groove 19 therefore define a first and a second anchoring means for the fastening strap 14 which downwardly depends therefrom beyond the peripheral edge of helmet 10.

At the rear end 10*b* of helmet 10, as illustrated in FIGS. 2 and 3, a tapered square-sectioned transverse hole 20 is cut in the upper surface of shell 12 through a fraction of its thickness, this fraction being approximately one quarter of its total thickness in this case. Hole 20 is correctly dimensioned to be flatly engaged by a flat, square band holder 22 having two transverse slots in which a loop band 24 is inserted, thus forming third anchoring means for holding loop band 24. Hole 20 has a downward transverse extension (FIG. 3) that allows loop band 24 to pass completely through shell 12 and hang freely from band holder 22 inside and under shell 12. As shown in FIG. 3, a transverse groove 26 is cut into the thickness of shock-absorbing shell 12 on its interior surface at rear end 10*b*, along a downwardly projecting integral tongue 27. Therefore, although loop band 24 freely hangs from band holder 22, it is restricted in its lateral and backward movements due to the fact that its hangs in groove 26. It can thus only move towards the front end 10*a* of helmet 10 when positioned in groove 26.

FIGS. 1 to 5 show an elongated abutment plate 28 having a slightly curved longitudinal axis, thus defining a slightly concave shape, the curvature radius of which generally corresponds to the curve of the occipital bone of the skull of a person. As illustrated in FIGS. 4 and 5, the two extremities 28*a*, 28*b* of abutment plate 28 are slightly wider than the rest of abutment plate 28 and are each provided with at least one widthwise slot, e.g. two slots 30. The upper part of abutment plate 28 has an upward projection 32 provided with one short lengthwise slot 34. Abutment plate 28 is preferably made of a rigid though slightly flexible material.

As shown in FIGS. 1, 2 and 3, loop band 24 engages slot 34 to securely attach abutment plate 28 to rear end 10*b* of helmet 10. Loop band 24 is sewn (or any other suitable fastening means) so as not to let abutment plate 28 escape. Abutment plate 28 can thus pivot around band holder 22, hanging from loop band 24, as suggested in FIG. 5, freely towards front end 10*a* but restricted by groove 26 towards rear end 10*b*.

FIGS. 1 and 2 show that rear part 14*b* of fastening strap 14 is threaded into slots 30 of first and second end 28*a*, 28*b* of abutment plate 28. It is understood that any other attachment means for adjustably attaching abutment plate 28 to fastening strap 14 are acceptable.

By this attachment means, abutment plate 28 can be adjustably positioned along fastening strap 14, so that the latter may be easily adjusted in turn to the cyclist's head H. Also, fastening strap 14 can be made of a single part, since strap 14 does not end at each extremity 28*a*, 28*b* of abutment plate 28. This is rather advantageous when manufacturing the helmet, since it necessitates one part less than the similar helmets of the prior art including an abutment plate.

Abutment plate 28 is thus spacedly positioned just under tongue 27 of shell 12.

In use, as shown in FIG. 3, helmet 10 is worn by a cyclist C in a conventional manner on his head H. The cyclist's head H defines a sagittal plane being vertical and dividing head H into right and left halves and an occipital bone of the skull over the nape. Fastening strap 14 is buckled under the chin of the cyclist's head H with attachment member 18, and its length is adjusted with length adjuster 16 so that helmet 10 may appropriately be fastened to head H of cyclist C, as is known in the art. By buckling and tightening fastening strap 14, helmet 10 is retained at its front end 10*a* by the front part 14*a* of fastening strap 14 and at its rear end by band holder 22 and loop band 24, the latter being linked to abutment plate 28 which is attached to the rear part 14*b* of fastening strap 14 (FIG. 4). Fastening strap 14 forms a V on each side of the cyclist's head H, one front strap 14*a* lying alongside the temples and the cheeks, while one rear strap 14*b* lies alongside the skull behind the ears, originating from abutment plate 14, each front strap 14*a* joining one rear strap 14*b* just under the ear.

Since abutment plate 28 is in adjustable relation with fastening strap 14 because it is attached thereto, abutment plate 28 will bear on the occipital bone when fastening strap 14 is attached under the chin of head H and will disengage the occipital bone when fastening strap 14 is released. Therefore, by buckling fastening strap 14, the cyclist not only fastens helmet 10 on his head but also abuts abutment plate 28 on his occipital bone, the curvature in abutment plate 28 registering with the one in the occipital bone.

Helmet 10 defines a longitudinal vertical plane dividing it into two symmetrical halves. Groove 26 being correctly dimensioned to receive loop band 24, it positions it in the longitudinal vertical plane when the helmet is held vertically. When the cyclist puts the helmet on, he must hold it over his head in a generally vertical position, which will position loop band 24 in groove 26 and thus position the center of abutment plate 28 in the vertical longitudinal plane of helmet 10. Abutment plate 28 will therefore only move in a frontward position, from groove 26 to bear on the occipital bone of the skull.

Abutment plate 28 serves two purposes. Firstly, it positions loop band 24 almost vertically (FIG. 4) to allow the latter to apply a correspondingly oriented force on helmet 10 to retain it on the cyclist's head H. Secondly, and most importantly, it will hamper or prevent the frontward tilting of helmet 10 in a sagittal plane, for it will bear on the occipital bone. Indeed, if helmet 10 is forced forwardly, band holder 22 will be forced in the same direction and consequently loop band 24 will apply an upward and frontward force on abutment plate 28. The latter will therefore apply a corresponding force on the occipital bone. Since rear part 14*b* of fastening strap 14 downwardly retains abutment plate 28, it will prevent it from any upward movement, and the resulting force applied by abutment plate 28 on the occipital bone will be a frontward one. Helmet 10 will therefore be prevented from tilting frontwardly in a sagittal plane by the combination of abutment plate 28, loop band 24 and fastening strap 14.

Loop band 24 can pivot around an axis perpendicular to the sagittal plane at band holder 22 and simultaneously allow abutment plate 28 to pivot in all directions, since it is free to do so at the lower extremity of loop band 24. This is an important improvement when compared to prior art, since the comfort of the cyclist wearing helmet 10 will be considerably increased. Indeed, abutment plate 28 will be allowed to tilt in any direction, and thus will conform itself to the particular shape of the cyclist's head. For example, if the cyclist has an irregular lump of hair at the back of his head as the hair fashion dictates, abutment plate 28 will pivot, possibly in a three-dimensional fashion, to abut with its whole surface, if possible, on the head of the cyclist. Loop band 24 thus prevents abutment plate 28 from abutting on the cyclist's head in a non-conforming, potentially painful way.

It is important to note that, in the present text, reference to upward or downward directions when describing the headgear relate to the position this headgear would have when worn by a vertically standing person.

It is understood that, in this invention, when a reference is made to a cyclist helmet or protective headgear, its use is not restricted thereto. For example, such a headgear could be used for rollerblading, rollerskating, or other similar activities that imply high falling risks.

I claim:

1. A protective headgear for use on a person's head, this head having an occipital bone over the nape and a sagittal plane being vertical and dividing the person's head into right and left halves, said headgear comprising a shock-absorbing shell defining a front and a rear end, said headgear further comprising a fastening strap attached to said headgear and destined to be adjustably and releasably attached under the chin of the person's head, flexible and rotatable link means pivotally attached to said headgear rear end and an abutment plate pivotally and downwardly depending from said link means and attached to said fastening strap, said abutment plate being destined to bear upon said occipital bone when said headgear is worn by the person and therefore hamper or prevent any tilting of said headgear frontwardly in the sagittal plane; said abutment plate being in adjustable relation with said fastening strap, wherein said abutment plate will bear on said occipital bone when said fastening strap is attached under said chin and will disengage said occipital bone when said fastening strap is released;

said link means being a loop band attached to said headgear rear end, wherein said abutment plate downwardly extends spacedly under the lower periphery of said headgear and is free to pivot at the extremity of said loop band;

wherein said headgear defines a longitudinal vertical plane dividing it into two symmetrical halves, said shell further comprising an integral downwardly projecting tongue positioned at said rear end of said headgear, said tongue having a groove correctly dimensioned to receive said loop band so as to position the latter in said longitudinal vertical plane when said headgear is in a vertical position.

2. A protective headgear as defined in claim 1, wherein said abutment plate is elongated and its longitudinal axis defines a slight curve, said abutment plate, when bearing on said occipital bone, being destined to be so positioned that said curve register in a concave adjacent fashion with said occipital bone.

3. A protective headgear as defined in claim 2, wherein said abutment plate has at least two widthwise slots and said fastening strap engages said abutment plate in said at least two slots.

4. In combination, a protective headgear and fastening means for removably attaching said headgear to a person's head in an operative position of said fastening means in which said headgear is securely attached to the person's head, said headgear having a shock-absorbing shell defining a front and a rear end, a peripheral edge and a longitudinal plane of symmetry dividing said shell into two substantially symmetrical halves, said fastening means comprising:

a) a first and a second front strap segments depending from said shell peripheral edge near said shell front end on opposite lateral sides of said plane of symmetry and being attached to said headgear, said first and second front strap segments each defining a lower extremity;

b) an attachment member for adjustably and removably attaching the lower extremities of said first and second strap segments to one another, said attachment member being destined to link said first and second strap segments under the person's chin in said fastening means operative position;

c) a rear strap segment depending from said headgear peripheral edge at said rear end thereof and defining a lower extremity, said rear strap segment being attached to said headgear;

d) a substantially rigid abutment plate attached at said rear strap segment lower extremity and destined to adjustably abut against the person's head occipital bone in said fastening means operative position; and e) a first floating strap segment linking said first front strap segment to said abutment plate and a second floating strap segment linking said second front strap segment to said abutment plate;

wherein said fastening means is attached to said headgear solely by means of said first and second front strap segments and said rear strap segment.

5. The combination as defined in claim 4, wherein said first and second front strap segments are attached to said headgear by engagement through a first and a second openings linked together by means of a transverse groove in said shock-absorbing shell.

6. The combination as defined in claim 5, wherein said first and second front strap segments together with said first and second floating strap segments are made out from a single strap, said single strap sequentially engaging said attachment member at said first front strap segment lower extremity, said first opening, said transverse groove, said second opening, said attachment member at said second front strap segment lower extremity, said abutment plate and said attachment member at said first front strap segment lower extremity once again.

7. The combination as defined in claim 4, wherein said rear strap segment is a loop band pivotally holding said abutment plate at an intermediate portion thereof.

* * * * *